US010932537B2

(12) United States Patent
Maurello et al.

(10) Patent No.: US 10,932,537 B2
(45) Date of Patent: Mar. 2, 2021

(54) SHADE APPARATUS

(71) Applicant: JMM VISIONARY, LLC, Oceanside, NY (US)

(72) Inventors: John M Maurello, Oceanside, NY (US); John Michael Maurello, Oceanside, NY (US)

(73) Assignee: JRJ ALLIANCE, LLC, Oceanside, NY (US)

( * ) Notice: Subject to any disclaimer, the term of this patent is extended or adjusted under 35 U.S.C. 154(b) by 0 days.

(21) Appl. No.: 16/418,910

(22) Filed: May 21, 2019

(65) Prior Publication Data

US 2020/0367619 A1 Nov. 26, 2020

Related U.S. Application Data

(63) Continuation of application No. 15/458,341, filed on Mar. 14, 2017.

(60) Provisional application No. 62/278,793, filed on Jan. 14, 2016.

(51) Int. Cl.

| | |
|---|---|
| ***A45B 25/00*** | (2006.01) |
| ***A45B 23/00*** | (2006.01) |
| ***A63B 57/00*** | (2015.01) |
| *A45B 11/00* | (2006.01) |

(52) U.S. Cl.

CPC ..... *A45B 25/00* (2013.01); *A63B 57/00* (2013.01); *A45B 2011/005* (2013.01); *A45B 2023/0031* (2013.01); *A45B 2025/003* (2013.01)

(58) Field of Classification Search

CPC ..... A45B 2023/0012; A45B 2023/0006

See application file for complete search history.

(56) References Cited

U.S. PATENT DOCUMENTS

| | | | | |
|---|---|---|---|---|
| 581,691 | A | 5/1897 | Buchanan et al. | |
| 970,751 | A | 9/1910 | Pranke | |
| 2,821,204 | A | 1/1958 | Hartshorn | |
| 3,970,835 | A | 7/1976 | Crete | |
| 4,068,673 | A | 1/1978 | Bernardi | |
| 4,222,646 | A | 9/1980 | West | |
| 4,524,405 | A | 6/1985 | Heard | |
| 5,390,685 | A | 2/1995 | McCoy | |
| 5,678,585 | A | 10/1997 | May | |
| 5,937,881 | A | 8/1999 | Villa | |
| 5,947,138 | A | 9/1999 | DeAngelis | |
| 5,960,806 | A | 10/1999 | Steiner | |
| 6,899,388 | B1 * | 5/2005 | Enrique | A47C 7/66 297/129 |
| D533,207 | S | 12/2006 | Kennedy et al. | |
| 7,172,168 | B1 | 2/2007 | Kallas | |
| 7,740,048 | B2 | 6/2010 | Wilson | |
| 8,272,605 | B2 | 9/2012 | Fuchs | |
| 9,675,146 | B1 | 6/2017 | Howell | |
| 2003/0226941 | A1 | 12/2003 | Crain et al. | |
| 2007/0034342 | A1 | 2/2007 | Fill | |

(Continued)

*Primary Examiner* — Noah Chandler Hawk

(74) *Attorney, Agent, or Firm* — Law Offices of Alozie N. Etufugh, PLLC; Alozie Etufugh, Esq.

(57) ABSTRACT

The invention features a shade apparatus adapted to provide shade to an individual or individuals while they are outside and in need of shade from sunlight. Aspects of embodiments of the present invention contemplate a shade apparatus that is easily portable and easily adapted to the sun's changing positions, thereby providing the individual/user with shade from sunlight.

4 Claims, 9 Drawing Sheets

(56) References Cited

U.S. PATENT DOCUMENTS

| | | | |
|---|---|---|---|
| 2007/0209688 | A1 | 9/2007 | Earnshaw |
| 2012/0097202 | A1 | 4/2012 | Chen |
| 2013/0240007 | A1 | 9/2013 | Ashton |
| 2016/0258572 | A1 | 9/2016 | Ben Meir et al. |

* cited by examiner

SHADE APPARATUS

CROSS-REFERENCE TO RELATED APPLICATIONS

This application is a continuation of, claims the benefit of, and is related to, U.S. Non-Provisional patent application Ser. No. 15/458,341, entitled, SHADE APPARATUS as filed on Mar. 14, 2017. This application also claims the benefit of, and is related to, Applicant's following provisional patent application: U.S. Provisional Patent Application No. 62/278,793 titled "SHADE APPARATUS" filed Jan. 14, 2016, which is incorporated herein in its entirety.

FIELD OF THE INVENTION

The present invention relates, in general, to an adjustable shade apparatus having multiple applications such as sports, gardening, work outdoors etc.

BACKGROUND OF THE INVENTION

The inability to provide adequate shade while one is outside, is a reason why a good number of people do not engage in certain outdoor activities. The lack of shade also affects sporting performance of athletes and sportsmen as they engage in their respective sports. Existing shade systems such as umbrellas fail to address the ever changing needs of people working outside as the sun is constantly moving thus requiring a shade system that adapts with the changing position of the sun. As such, there is a need for an apparatus which is easily adaptable for providing shade to a person regardless of the sun's position. In addition, there is a need for a shade apparatus that is portable and adaptable for use and/or installation onto existing devices, structures and/or apparatuses.

SUMMARY OF THE INVENTION

The present invention contemplates a shade apparatus which is configured to provide an individual with shade regardless of the sun's position or the direction of its rays. The apparatus contemplates being able to be set at angles or positions at varying heights, angles, sides etc. all in an effort to shield the individual from the sun. As such, the sun's position would not matter as the apparatus may be easily adjusted to shield the individual.

An aspect of an embodiment of the present invention contemplates a shade apparatus which may include a tripod arrangement having three legs connect at a tripod base, a first junction connected with the tripod base, a first pole having a first end extending from the first junction and having a second end extending into a second junction, a second pole having a first end extending from the second junction, the second pole further comprises of a second end extending into a first point of a third junction, and a shade producing canvas or shade canvas structure, extending from a second point of the third junction.

In an aspect of an embodiment of the present invention, the first junction may be multi directional, multi axial, multi angular and multi rotational. As such, the first junction may be capable of moving in multiple directions about different axes.

In an aspect of an embodiment of the present invention, the second junction may be multi directional, multi axial multi angular and multi rotational. As such, the second junction may be capable of moving in multiple directions about different axes.

In an aspect of an embodiment of the present invention, the third junction may be multi directional, multi axial, multi angular and multi rotational. As such, the third junction may be capable of moving in multiple directions about different axes.

In an aspect of an embodiment of the present invention, the first pole may be enabled to slide in or slide out of the first junction.

In an aspect of an embodiment of the present invention, the second pole may be enabled to slide in or slide out of the second junction.

In an aspect of an embodiment of the present invention, the third junction may be structurally configured to enable spin of the shade canvas structure and the second pole.

In an aspect of an embodiment of the present invention, the first junction may have a locking mechanism. In another aspect, the locking mechanism may be configured to lock the junction and/or the first pole in position.

In an aspect of an embodiment of the present invention, the second junction has a locking mechanism. In another aspect, the locking mechanism may be configured to lock the junction and/or the second pole in position.

In an aspect of an embodiment of the present invention, the shade apparatus may include a hook extending downward from the tripod base.

In an aspect of an embodiment of the present invention, the first and second poles may be enabled to twist about an axis.

In an aspect of an embodiment of the present invention, each of the tripod legs of the shade apparatus may include a rubber foot at the base.

In an aspect of an embodiment of the present invention, each first end of the first and second poles may have a rubber grip handle.

In an aspect of an embodiment of the present invention, each of the first and second junctions may include any one or a combination of: collar locks, lever cam locks, flat cam locks, rotational angle piece.

In an aspect of an embodiment of the present invention, the shade apparatus may include tripod leg pivot caps.

In an aspect of an embodiment of the present invention, the poles and tripod are foldable onto one another.

In an aspect of an embodiment of the present invention, the shade canvas structure is enabled to block harmful rays from the sun.

In an aspect of an embodiment of the present invention, the shade canvas structure is enabled to produce shade that is 10-30 degrees cooler than surrounding un-shaded areas. This may be made possible by way of structural, positional and/or material design of the canvas.

In an aspect of an embodiment of the present invention, the shade canvas structure is enabled to lower the relative feel of the area(s) under its shade. This may be made possible by way of structural, positional and/or material design of the canvas.

Additional aspects, objectives, features and advantages of the present invention will become apparent from the following description of the preferred embodiments with reference to the attached drawings. The invention has been described in detail with particular reference to certain preferred embodiments thereof, but it will be understood that variations and modifications can be effected within the spirit and scope of the invention.

DETAILED DESCRIPTION OF THE INVENTION

Figure 1:
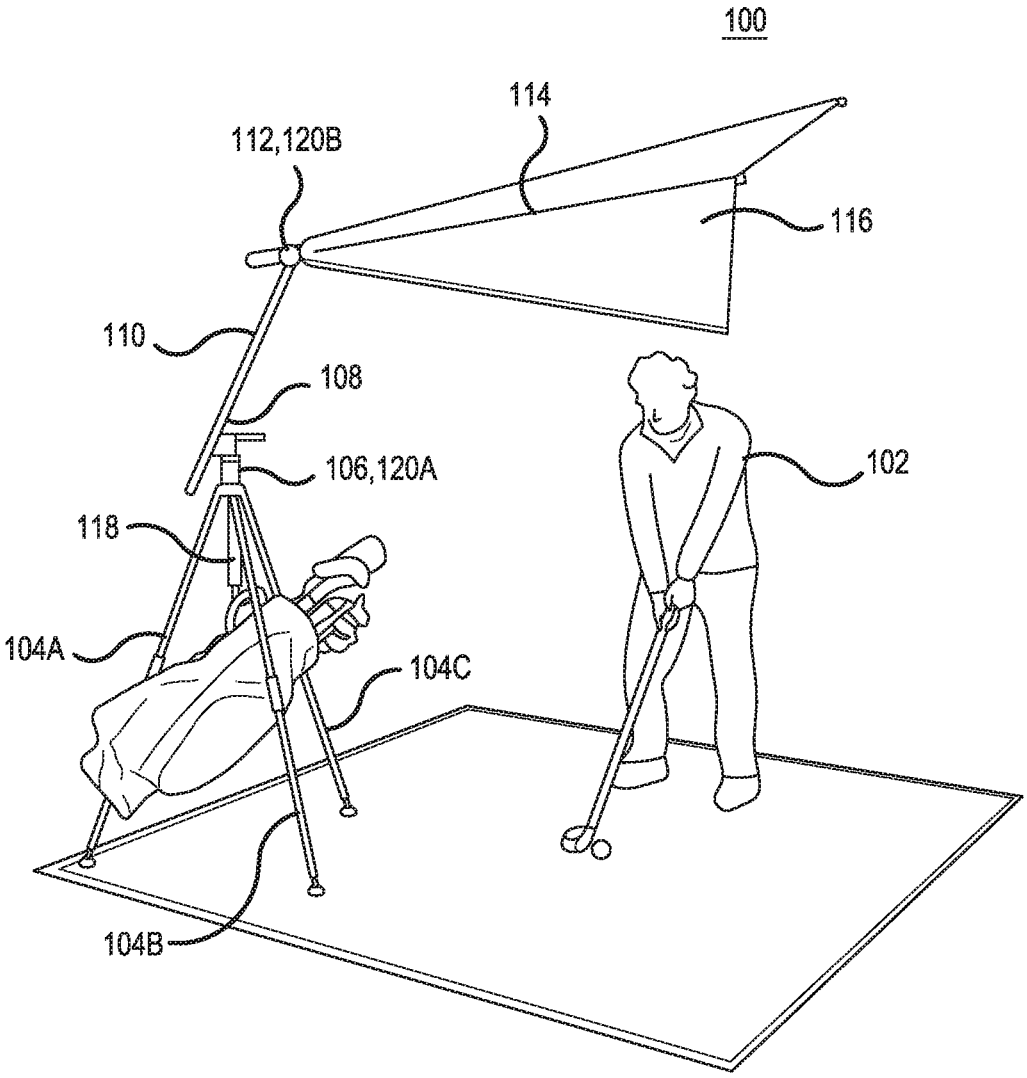
FIG. 1 illustrates a shade apparatus, according to an aspect of an embodiment of the present invention.

Referring now to FIG. 1 a shade apparatus 100 is shown according to an aspect of an embodiment of the present invention. Shade apparatus 100 is shown being used by player/user 102 engaged in an activity using shade apparatus 100 to generate shade. Shade apparatus 100 may include tripod legs 104A-104C which are used to position and stabilize shade apparatus 100 on the ground. Tripod legs 104A-304C may be connected to tripod base 106. In one aspect of an embodiment of the present invention, the connection of each of tripod legs 104A-304C may be characterized by a movable, adjustable, swivel joint at each connection enabling the folding of each leg for transport of shade apparatus 100 after use.

Tripod base 106 may further be connected to first junction 108. First junction 108 may, in one aspect of an embodiment of the present invention, serve as the holding or attachment mechanism for first pole 110. In an aspect, pole 110 may be slidably positioned within a sleeve of junction 108. This arrangement enables pole 110 to slide to a desired length within the sleeve of junction 108 when the user adjusts the height and/or angle of the shade produced by shade apparatus 100. Junction 108 may include locking mechanism 120A for locking pole 110 in place. In an aspect of an embodiment of the present invention, pole 110 may be rotatable about its axis.

One end of pole 110 extends away from junction 108 to connect with second junction 112. Second junction 112 also acts as a connection junction for second pole 114 of canvas structure 116. Second junction 112 may also, in an aspect of an embodiment of the present invention, include a locking mechanism 120B for enabling the sliding and adjustment of pole 114 within junction 112. Pole 114 may, in one aspect, be slidably positioned within a sleeve of junction 112, with the arrangement enabling pole 114 slid to a desired length for adjusting the angle of the shade produced by canvas structure 116.

In an aspect of an embodiment of the present invention, the end of pole 110 unconnected with junction 108 may feature rubber grip for ease of use and handling.

In an aspect of an embodiment of the present invention, canvas structure 116 may include a canvas of any shape and rods used to maintain the desired shape of the canvas.

In an aspect of an embodiment of the present invention, a hook 118 may extend downward from the base of tripod base 106. Hook 118 may be used for a variety of purposes, including, without limitation, hanging sporting bags, sporting accessories etc.

In an aspect of an embodiment of the present invention, junctions 108 and 112 may be multi directional, multi axial, multi angular and multi rotational. As such, junctions 108 and 112 may be capable of moving in multiple directions about different axes. In another aspect, each or any one of junctions 108 and 112 may include a ball rotation joint connected to the elements of each junction in connection with poles 110 and 114.

In another aspect of an embodiment of the present invention, locking mechanisms 120A and 120B may include any one or more of: collar locks, lever cam locks, flat cam locks, or a rotational angle piece.

Referring now to FIGS. 2A-2G, a shade apparatus 200 having an additional pole 214 and detailed renderings of shade apparatus junctions 222A and 222B, are shown according to aspects of embodiments of the present invention. As with shade apparatus 100 above, shade apparatus 200 is shown being used by player/user 202 who seeks to play or engage in an activity using shade apparatus 200 to generate shade. Shade apparatus 200 may include tripod legs 204A-204C which are used to position and stabilize shade apparatus 200 on the ground. Tripod legs 204A-204C may be connected to tripod base 206. In one aspect of an embodiment of the present invention, the connection of each of tripod legs 204A-204C may be characterized by a movable, adjustable joint at each connection enabling the folding of each leg for transport of shade apparatus 200 after use. In another aspect of an embodiment of the present invention, legs 204A-204C may be telescopic, thereby enabling the shortening of each leg when user 202 takes down and transports shade apparatus 200.

Tripod base 206 may further be connected to first junction 208. First junction 208 may, in one aspect of an embodiment of the present invention, serve as the holding or attachment mechanism for first pole 210. In an aspect, pole 210 may be slidably positioned within a sleeve of junction 208. This arrangement enables pole 210 to slide to a desired length within the sleeve of junction 208 when user adjusts the height and/or angle of the shade produced by shade apparatus 200. Junction 208 may include locking mechanism 222A for locking pole 210 in place. In an aspect of an embodiment of the present invention, pole 210 may be rotatable about its axis.

In an aspect of an embodiment of the present invention, a hook 220 may extend downward from the base of tripod base 206. Hook 220 may be used for variety of purposes, including, without limitation, hanging sporting bags, accessories etc.

In an aspect of an embodiment of the present invention, pole 210 may be telescopic, having two parts that may be in a telescopic relationship with one another. This configuration aids in the adjustment of pole 210 by user 202 to attain the desired angle and/or height for pole 210.

One end of pole 210 extends away from junction 208 to connect with second junction 212. Second junction 212 also acts as a connection junction for second pole 214, which, in turn by way of the other end of pole 214, is connected to third junction 216. Second junction 212 may also, in an aspect of an embodiment of the present invention, include a locking mechanism 222B for enabling the sliding and adjustment of pole 214 within junction 212. Pole 214 may, in one aspect, be slidably positioned within a sleeve of junction 212, with the arrangement enabling pole 214 slide to a desired length when adjusting the length of pole 214. Connected to junction 216 and extending away from same, is adjustable canvas structure 218, which provides the desired shade of shade apparatus 200. In an aspect of an embodiment of the present invention, adjustable canvas structure 218 may include a canvas of any shape in along with rods used to maintain the desired shape of the canvas.

Figure 2A:
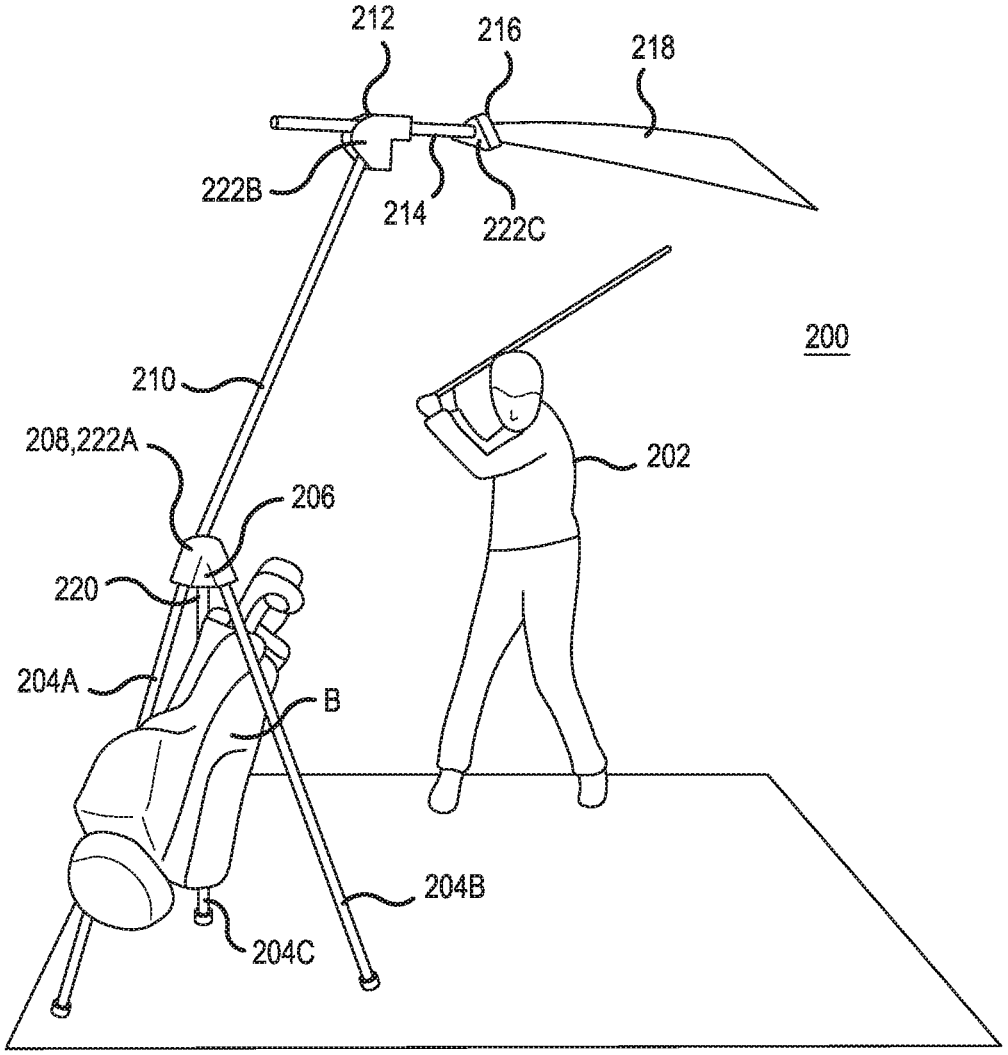
FIG. 2A illustrates a shade apparatus, having an additional pole, according to an aspect of an embodiment of the present invention.
Figure 2C:
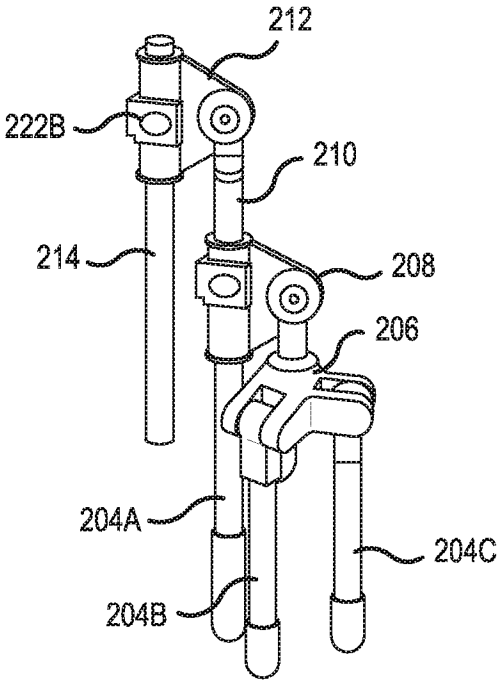
FIGS. 2B-2D illustrate elements of the shade apparatus junctions, according to aspects of embodiments of the present invention.
Figure 2B:
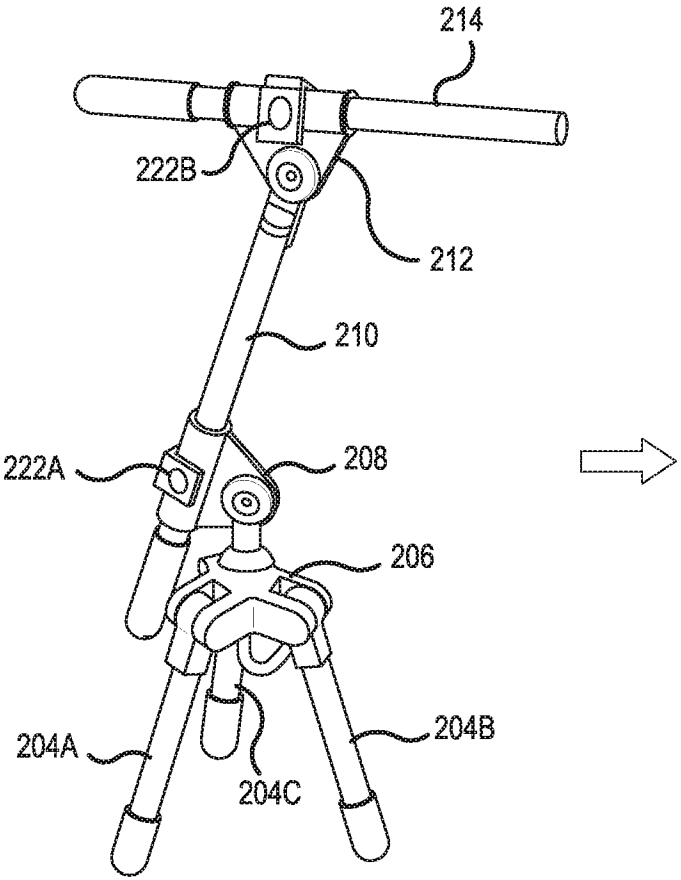
Figure 2D:
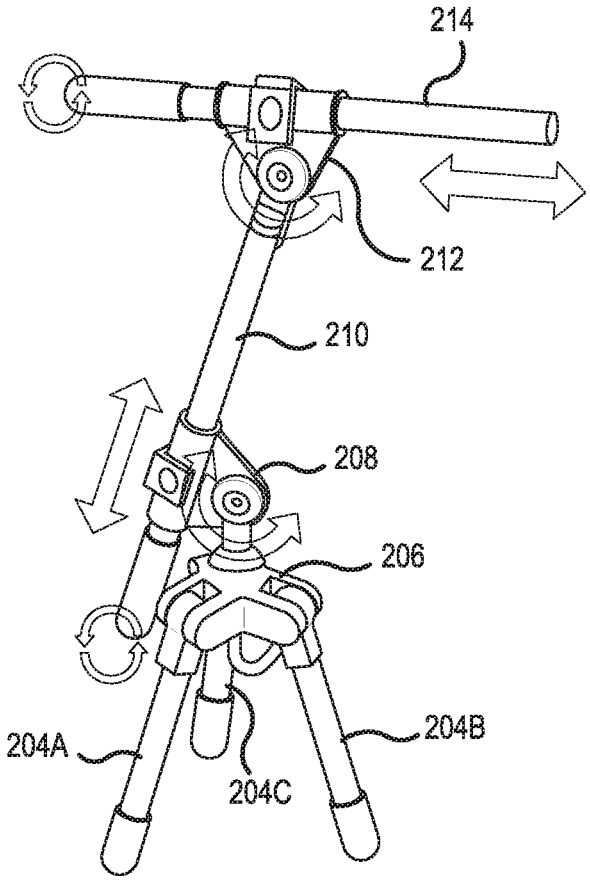
Figure 2G:
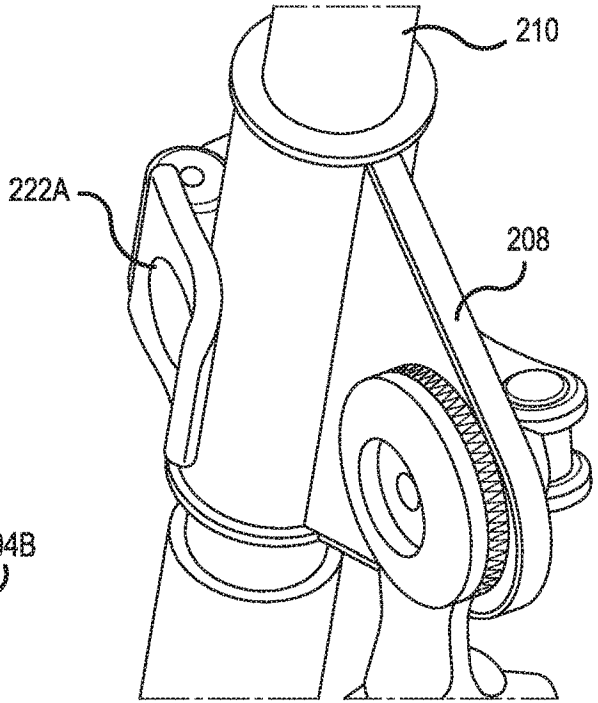
FIGS. 2E-G illustrate further details of the junctions according to aspect(s) of embodiment(s) of the present invention.
Figure 2F:
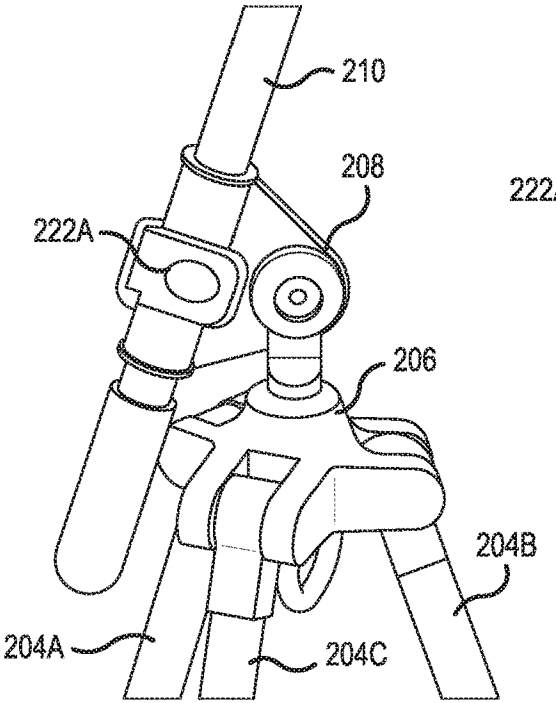
Figure 2E:
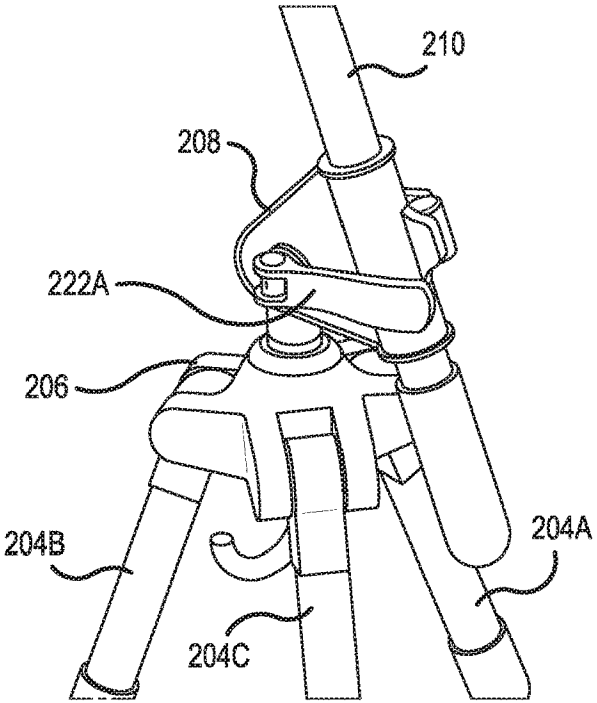

In another aspect of an embodiment of the present invention, legs 204A-204C may each comprise of telescopic portions which enable the shortening of each leg as seen in FIGS. 2B-2D. In addition, legs 204A-204C may include rubber caps at the base of each leg to generate friction with the ground/surface and prevent the legs from slipping.

Figure 3A:
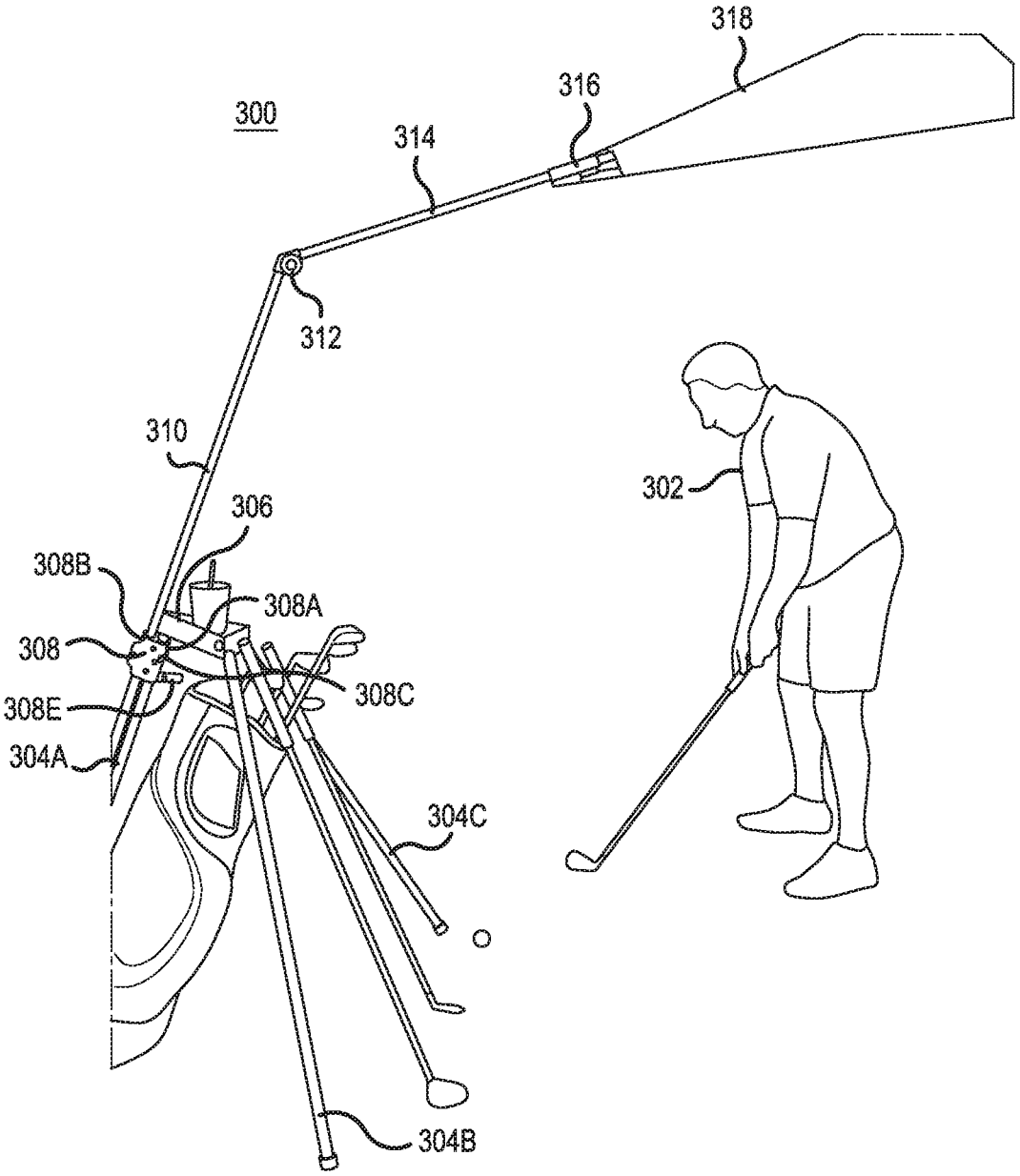
FIG. 3A illustrates a shade apparatus, according to another aspect of an embodiment of the present invention.
Figure 3B:
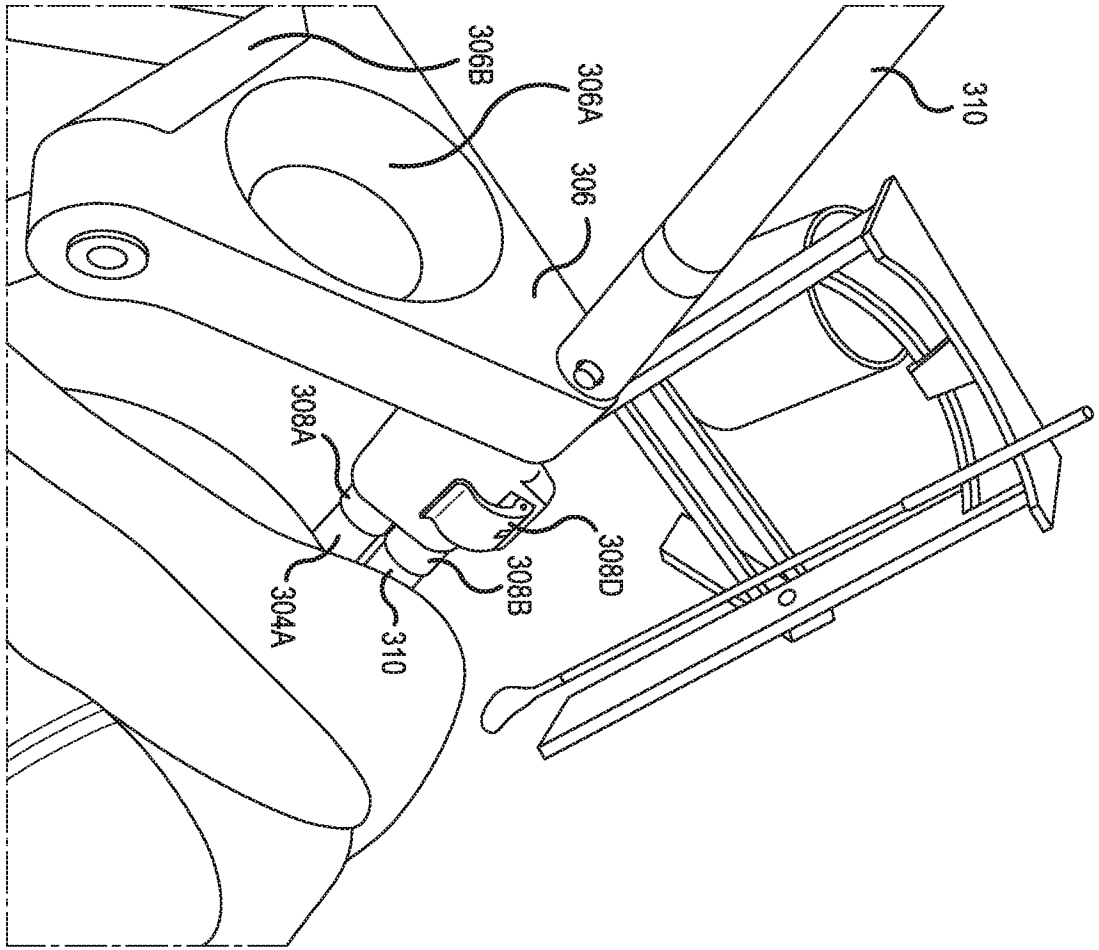
FIG. 3B illustrates a top perspective view of a tripod base according to an aspect of an embodiment of the present invention.

Referring now to FIGS. 3A & 3B shade apparatus 300 and a top perspective view of tripod base 306 are shown according to additional aspects of embodiments of the present invention. Shade apparatus 300 is shown being used by player/user 302 engaged in an activity using shade apparatus 300 to generate shade. Shade apparatus 300 may include tripod legs 304A-304C connected to tripod base 306, with leg 304A as the top leg and legs 304B and 304C bottom legs opposite top leg 304A. Tripod legs 304A-304C are used to position and stabilize shade apparatus 300 on the ground. In one aspect of an embodiment of the present invention, the connection of each of tripod legs 304A-304C to tripod base 306 may be characterized by a movable, adjustable, swivel joint at each connection enabling the inward folding of each leg after use of shade apparatus 300.

In another aspect of an embodiment of the present invention, legs 304A-304C may each comprise of telescopic portions which enable the shortening of each leg for ease of transport following use of shade apparatus 300. In addition, legs 304A-304C may include rubber caps at the base of each leg to generate friction with the ground/surface and prevent the legs from slipping.

In an aspect of an embodiment of the present invention, tripod base 306 may include one or more holders 306A and 306B. Holders 306A and 306B may serve to hold different things including, cups, keys, phones etc.

Shade apparatus 300 includes attachment mechanism 308 having a first sleeve 308A and second sleeve 308B. In an aspect of an embodiment of the present invention, top leg 304A may be slidably positioned within sleeve 308A of attachment mechanism 308. Sleeve 308A may include, in one aspect of an embodiment of the present invention, lock 308C for locking attachment mechanism 308 onto leg 304A.

Slidably positioned within sleeve 308B is first pole 310. Sleeve 308B may include lock 308D for keeping pole 310 in position after a desired height of pole 310 has been attained by sliding pole 310 within sleeve 308B. In an aspect of an embodiment of the present invention, pole 310 may be rotatable about its axis.

Pole 310 extends away from attachment mechanism 308 to connect with first adjustable junction 312. Junction 312 may be adjustable in that is foldable by way of a swivel joint, in one aspect. A second pole 314 connects with junction 312 and extends into a first entry point of second junction 316. Junction 316 may also, in an aspect of an embodiment of the present invention, be adjustable and may be able to rotate about the axis of pole 314. An adjustable canvas structure 318 is connected with junction 316. Adjustable canvas structure 318 includes canvas for providing the shade of shade apparatus 300. In an aspect of an embodiment of the present invention, canvas structure 318 may include a canvas of any shape and rods used to maintain the desired shape of the canvas.

In another aspect of an embodiment of the present invention, to enable ease in changing the orientation of shade apparatus 300, junctions 312 and 316 may be multi directional, multi axial, multi angular and multi rotational, wherein the first junction is capable of moving in multiple directions about different axes. This may be made possible by a ball rotation joint between or connected to the elements of the respective junction connected to a pole.

In another aspect of an embodiment of the present invention, junctions 312 and 316 may include locking mechanisms 320A and 320B respectively for locking each junction in place.

In another aspect of an embodiment of the present invention, locking mechanisms 308C, 308D, 320A and 320B may include any one or more of: collar locks, lever cam locks, flat cam locks, or a rotational angle piece.

In further aspects of embodiments of the present invention, pole connections to their respective junctions may be implemented using bolt systems, where the poles may be removably bolted to the junctions or screw on systems where the ends of the poles have threaded ends that screw easily into corresponding threaded junction entry points.

In a further aspect of an embodiment of the present invention, any one of legs 104A-104C, 204A-204C, 304A-304C may have pivot caps.

Figure 4A:
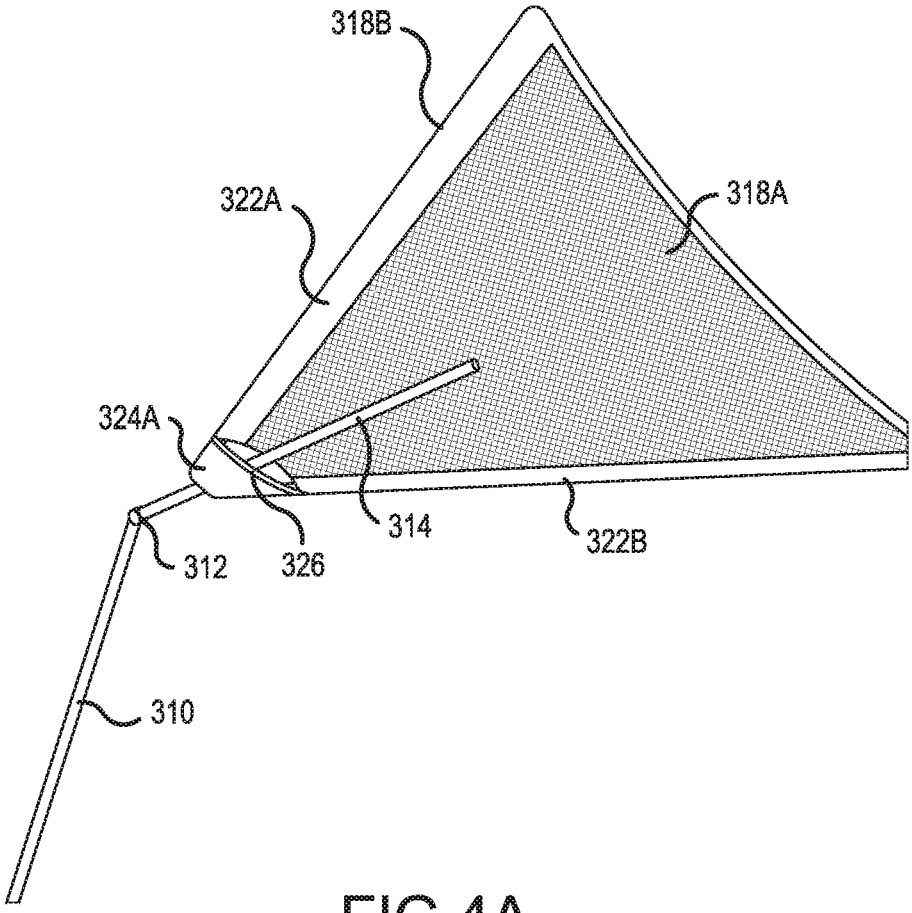
FIGS. 4A & 4B illustrate views of a canvas structure and junction according to aspects of embodiments of the present invention.
Figure 4B:
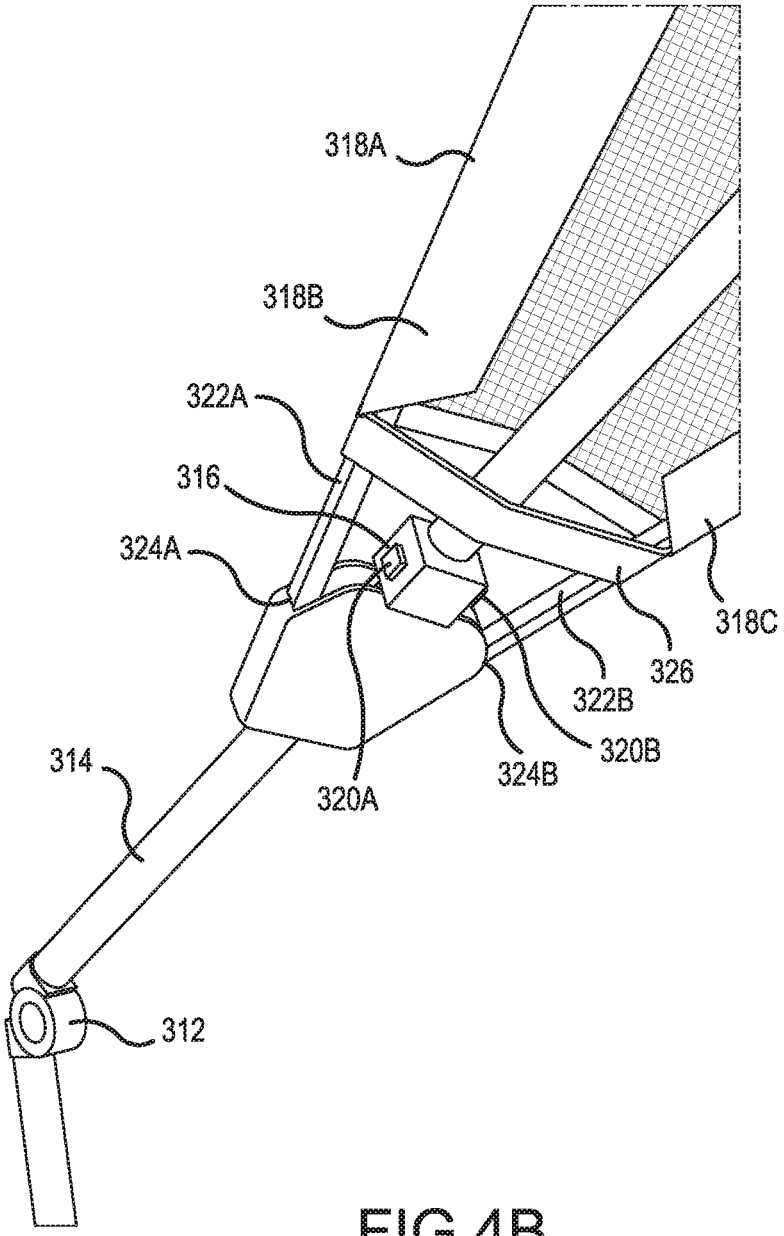

Referring now to FIGS. 4A and 4B, views of canvas structure 318 and junction 316 are shown according to aspects of embodiments of the present invention. In an aspect of an embodiment of the present invention, canvas structure 318 may include canvas 318A and canvas arms 322A and 322B. In addition to providing shade, canvas 318A may serve as an advertisement panel—enabling entities to place their name or brands on canvas 318A.

In an aspect of an embodiment of the present invention, canvas arms 322A and 322B may comprise of two rods slidably positioned within sleeves 318B and 318C of canvas 318A. Canvas structure 318 may further include a base 324 having two canvas arm receptacles 324A and 324B for removably anchoring each of canvas arms 322A and 322B respectively. In an aspect of an embodiment of the present invention, each receptacle may allow for folding of each arm. In another aspect, canvas structure 318 may include folding mechanism 326 having two arms where each arm is connected to each of canvas arms 322A and 322B. This enables canvas arms 322A and 322B to be folded toward pole 314 when shade apparatus 300 being transported after use.

Canvas structure 318 may be slidably positioned onto pole 314 and may be locked in place using mechanism 320B of junction 316. Canvas structure 318 may be held in place, in one aspect, by having the user slide canvas structure 318 onto pole 314 and then placing junction 316 with locking mechanism 320B after canvas structure 318 thereby blocking base 324 and preventing the structure from sliding out.

The invention has been described in detail with particular reference to certain preferred embodiments thereof, but it will be understood that variations and modifications can be effected within the spirit and scope of the invention.

What is claimed is:

1. A shade apparatus comprising:

a tripod arrangement having three legs, wherein the legs are foldably connected to a tripod base, the legs comprising of a top leg and two bottom legs, wherein the tripod base further comprises at least one holder having a well for holding user items;

an attachment mechanism, attached to the top leg, the attachment mechanism comprising of a first sleeve, allowing positioning of the top leg therethrough, and a second sleeve;

a first pole, slidably positioned within the second sleeve of the attachment mechanism, wherein an end of the first pole extends away from the attachment mechanism and into a first adjustable junction;

a second pole, comprising first and second ends, wherein said first end of the second pole is one of: connected to the first adjustable junction or slidably positioned through the first adjustable junction, and wherein the second end of the second pole is slidably positioned through a second junction; and a shade canvas structure, slidably positioned over said second pole, adjustably connected to the second adjustable junction and extending from the second adjustable junction, wherein said shade canvas structure comprises of a base having two canvas arm receptacles, wherein said shade canvas structure is held in place by placement of said second adjustable junction between said shade canvas structure base and second end of second pole.

2. The shade apparatus of claim 1 wherein at least one of the first or second junctions is multi directional, multi axial, multi angular, multi rotational, or capable of moving in multiple directions about different axes.

3. The shade apparatus of claim 1 further comprising of a hook extending downward from the tripod base.

4. The shade apparatus of claim 1 wherein each of the first and second junctions comprise one or a combination of: wherein each of the first and second junctions comprises one or a combination of: a collar lock, a lever cam lock, a flat cam lock, or a rotational angle piece which enables rotation of the junction.

* * * * *